United States Patent [19]

Blair et al.

[11] Patent Number: 4,923,778

[45] Date of Patent: May 8, 1990

[54] USE OF HIGH PERCENT SOLIDS FOR IMPROVED LIQUID TONER PREPARATION

[75] Inventors: David E. Blair, Chester Springs; Bradley J. Gollhardt, Kennett Square; James R. Larson, West Chester, all of Pa.

[73] Assignee: D X Imaging, Lionville, Pa.

[21] Appl. No.: 289,179

[22] Filed: Dec. 23, 1988

[51] Int. Cl.[5] ..... G03G 9/12

[52] U.S. Cl. ..... 430/137; 430/114; 430/115

[58] Field of Search ..... 430/137, 114, 115

[56] References Cited

U.S. PATENT DOCUMENTS

| | | | |
|---|---|---|---|
| 4,631,244 | 12/1986 | Mitchell | 430/137 |
| 4,663,264 | 5/1987 | Mitchell | 430/115 |
| 4,670,370 | 6/1987 | Taggi | 430/137 |
| 4,681,831 | 7/1987 | Larson et al. | 430/114 |
| 4,702,984 | 10/1987 | El-Sayed et al. | 430/115 |
| 4,702,985 | 10/1987 | Larson | 430/115 |
| 4,707,429 | 11/1987 | Trout | 430/115 |
| 4,740,444 | 4/1988 | Trout | 430/137 |
| 4,758,494 | 7/1988 | El-Sayed | 430/137 |
| 4,760,009 | 7/1988 | Larson | 430/137 |
| 4,772,528 | 9/1988 | Larson et al. | 430/114 |
| 4,780,388 | 10/1988 | Larson | 430/15 |
| 4,780,389 | 10/1988 | El-Sayed | 430/115 |
| 4,783,388 | 11/1988 | El-Sayed et al. | 430/115 |
| 4,783,389 | 11/1988 | Trout et al. | 430/137 |
| 4,794,651 | 12/1988 | Landa et al. | 430/114 |
| 4,798,778 | 1/1989 | El-Sayed et al. | 430/137 |
| 4,820,605 | 4/1989 | El-Sayed | 430/115 |

FOREIGN PATENT DOCUMENTS 2169416A 7/1986 United Kingdom .

*Primary Examiner*—Paul R. Michl
*Assistant Examiner*—Jeffrey A. Lindeman

[57] ABSTRACT

Process for preparation of toner particles for electrostatic liquid developers utilizing a single vessel wherein (A) a thermoplastic resin and hydrocarbon liquid having a Kauri-butanol value of less than 120 at a total of solids of at least 22% by weight are dispersed in the vessel by moving particulate media (crating shear) at elevated temperature to plasticize and liquify the resin, (B) while the particulate media are maintained in continuous motion the dispersion is cooled whereby the resin precipitates in the form of toner particle having an average by area particle size of 10 μm or less, and (C) the particulate media are removed. Liquid electrostatic developers are prepared by the addition of a charge director compound. The liquid developers are prepared in a shorter time that previously known processes. The liquid developers are useful for preparation of copies and proofs of various colors.

28 Claims, 3 Drawing Sheets

USE OF HIGH PERCENT SOLIDS FOR IMPROVED LIQUID TONER PREPARATION

TECHNICAL FIELD

This invention relates to an improved process for the preparation of toner particles. More particularly this invention relates to a process for the preparation of toner particles in a liquid medium for electrostatic imaging.

BACKGROUND OF THE INVENTION

It is known to develop a latent electrostatic image with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and nonpolar liquid. Generally a suitable colorant is present such as a dye or pigment The colored toner particles are dispersed in the nonpolar liquid which generally has a high-volume resistivity in excess of $10^9$ ohm centimeters, a low dielectric constant below 3.0 and a high vapor pressure. The toner particles are <30 μm determined by Malvern 3600E Particle Sizer described below. After the latent electrostatic image has been formed, the image is developed by the colored toner particles dispersed in said nonpolar liquid and the image may subsequently be transferred to a carrier sheet.

There are many methods of making liquid toners. In one method of preparation of the improved toner particles are prepared by dissolving at an elevated temperature one or more polymers in a nonpolar dispersant, together with particles of a pigment, e.g., carbon black. The solution is cooled slowly, while stirring, whereby precipitation of particles occurs. It has found that by repeating the above process some material was observed that was greater than 1 mm in size. By increasing the ratio of solids to nonpolar liquid the toner particles can be controlled within the desired size range, but it has been found that the density of images produced may be relatively low and when a transfer is made to a carrier sheet, for example, the amount of image transferred thereto may be relatively low. The particles in this process are formed by a precipitation mechanism and not grinding in the presence of particulate media and this contributes to the formation of an inferior toner.

In another method of preparation of toner particles, the plasticizing of the thermoplastic polymer and pigment with a nonpolar liquid forms a gel or solid mass which is shredded into pieces, more nonpolar liquid is added, the pieces are wet-ground into particles, and grinding is continued which is believed to pull the particles apart to form fibers extending therefrom. While this process is useful in preparing improved toners, it requires long cycle times and excessive material handling, i.e., several pieces of equipment are used.

In yet another method of preparation of toner particles for electrostatic imaging, the following steps are followed: A. dispersing at an elevated temperature in a vessel a thermoplastic resin, a nonpolar liquid having a Kauri-butanol value of less than 30, and optionally a colorant, at a total % solids of less than 18% by weight by means of moving particulate media whereby the moving particulate media creates shear and/or impact, while maintaining the temperature in the vessel at a temperature sufficient to plasticize and liquify the resin and below that at which the nonpolar liquid boils and the resin and/or colorant, if present, decomposes, B. cooling the dispersion to permit precipitation of the resin out of the dispersant, the particulate media being maintained in continuous movement during and subsequent to cooling whereby the toner particles are <30 μm determined by Malvern 3600E Particle Sizer described below and a plurality of fibers are formed, and C. separating the dispersion of toner particles from the particulate media. This method can provide toners with a particle size of 10 μm or less as determined by Malvern 3600E Particle Sizer but requires extremely long grinding times to achieve this desired particle size.

It has been found that the above disadvantages can be overcome and toner particles prepared by a process that does not require excessive handling of toner ingredients at elevated temperatures whereby toner particles having an average size (by area) of 10 μm or less determined by Malvern 3600E Particle Sizer are dispersed and formed in the same vessel with greatly reduced grinding times. Transfer of an image of the so prepared toner particles to a carrier sheet results in transfer of a substantial amount of the image providing a suitably dense copy or reproduction.

SUMMARY OF THE INVENTION

In accordance with this invention there is provided a process for the preparation of toner particles for electrostatic liquid developers comprising:

A. dispersing at an elevated temperature in a vessel a thermoplastic resin, and a hydrocarbon liquid having a Kauri-butanol value of less than 120, at such that the dispersion contains total % solids of at least 22% by weight by means of moving particulate media whereby the moving particulate media creates shear and/or impact, while maintaining the temperature in the vessel at a temperature sufficient to plasticize and liquify the resin and below that at which the hydrocarbon liquid boils and the resin decomposes, B. cooling the dispersion containing a total % solids of at least 22% by weight in said vessel to permit precipitation of the resin out of the dispersant, the particulate media being maintained in continuous movement during and subsequent to cooling whereby toner particles having an average by area particle size of 10 μm or less, and C. separating the dispersion of toner particles from the particulate media.

BRIEF DESCRIPTION OF THE DRAWINGS

The accompanying drawings which form a part of this invention include.

DETAILED DESCRIPTION OF THE INVENTION

Figure 1:
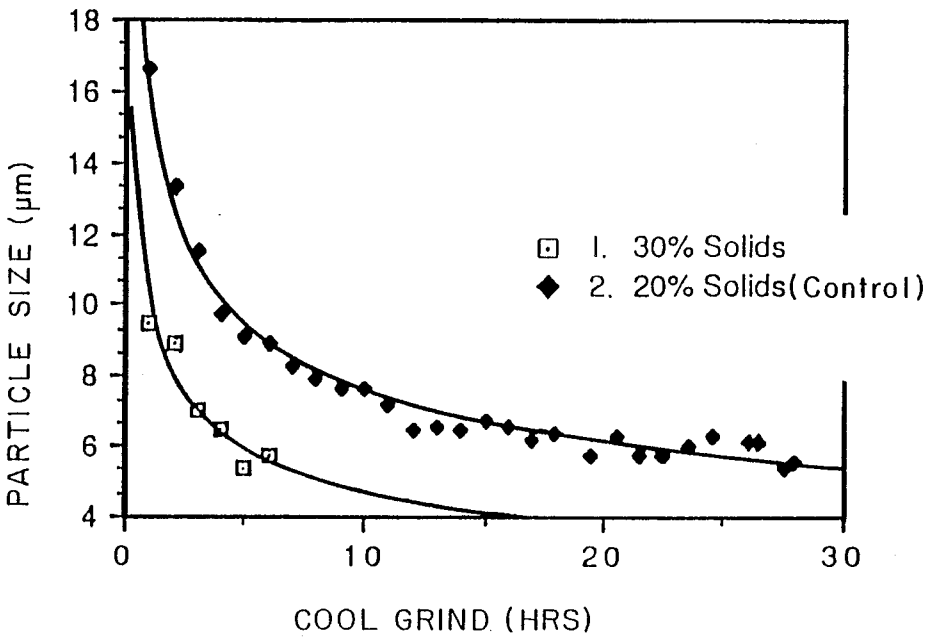
FIG. 1 is a plot of particle size (μm) at cool grind (hours) for a developer composition of the invention illustrated in Example 1 having 30% solids by weight and a similar plot of the developer composition having 20% solids by weight (control)

The process of this invention results in toner particles adapted for electrophoretic movement through a hydrocarbon liquid, generally a nonpolar liquid.

The toner particles are prepared from at least one thermoplastic polymer or resin, suitable colorants and hydrocarbon dispersant liquids as described in more detail below. Additional components can be added, e.g., charge director, adjuvants, polyethylene, fine particle size oxides such as silica, etc.

The dispersant hydrocarbon liquids are, preferably, nonpolar branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C, Isopar ®-H between 176° C and 191° C, Isopar ®-K between 177° C. and 197° C, Isopar ®-L between 188° C. and 206° C. and Isopar ®-M between 207° C. and 254° C. and Isopar ®-V between 254.4° C and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

Additional useful hydrocarbon liquids are Aromatic ®100, Aromatic ®150 and Aromatic ®200, manufactured by Exxon Corp., Houston, Tex. These liquid hydrocarbons have the following Kauri-butanol values (ASTM D1133), flash point, TTC, ° C. (ASTM D56), and vapor pressure, kPa at 38° C. (ASTM D2879).

| Liquid | Kauri-Butanol | Flash Point | Vapor Pressure |
|---|---|---|---|
| Aromatic ® 100 | 91 | 43° C. | 1.7 |
| Aromatic ® 150 | 95 | 66° C. | 0.5 |
| Aromatic ® 200 | 95 | 103° C. | 0.17 |

All of the dispersant hydrocarbon liquids have an electrical volume resistivity in excess of 10 ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D56. Isopar ®-L and Isopar ®-M have flash points of 61° C., and 80° C., respectively, determined by the same method. While these are the preferred dispersant nonpolar liquids, the essential characteristics of all suitable dispersant hydrocarbon liquids are the electrical volume resistivity and the dielectric constant. In addition, a feature of the dispersant nonpolar liquids is a low Kauri-butanol value less than 30, preferably in the vicinity of 27 or 28, determined by ASTM D1133. The ratio of resin to dispersant hydrocarbon liquid is such that the combination of ingredients becomes fluid at the working temperature. In use, the hydrocarbon liquid is present in an amount of 50 to 78% by weight, preferably 70 to 75% by weight, based on the total weight of liquid developer. The total weight of solids in the liquid developer is 22 to 50%, preferably 25 to 30% by weight. The total weight of solids in the liquid developer is solely based on the resin, including components dispersed therein, e.g., pigment component, adjuvant, etc.

Useful thermoplastic resins or polymers include: ethylene vinyl acetate (EVA) copolymers (Elvax ® resins, E. I. du Pont de Nemours and Company, Wilmington, Del.), copolymers of ethylene and an α,β-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), the percentages being by weight; polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, Del., etc., or blends thereof. Preferred copolymers are the copolymer of ethylene and an α,β-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 54 and a melt index of 100 and 500 determined at 190° C. respectively.

In addition, the resins have the following preferred characteristics:

1. Be able to disperse the metallic soap, colorant, e.g., pigment,
2. Be substantially insoluble in the dispersant liquid at temperatures below 40° C, so that the resin will not dissolve or solvate in storage,
3. Be able to solvate at temperatures above 50° C,
4. Be able to be ground to form particles between 0.1 μm and 3.6 μm, in diameter preferred size), e.g., determined by Horiba CAPA-500 centrifugal automatic particle analyzer, manufactured by Horiba Instruments, Inc., Irvine, Calif.; and between 1 μm and 10 μm, in diameter, e.g., determined by Malvern 3600E Particle sizer, manufactured by Malvern, Southborough, Mass., 5. Be able to form a particle (average by area) of 3.6 μm or less, e.g., determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 μm to less than 3.6 μm, and a particle size cut of 1.0 μm, and 10 μm average particle size determined by Malvern 3600E Particle Sizer, as described above, 6. Be able to fuse at temperatures in excess of 70° C. By solvation in 3. above, the resins forming the toner particles will become swollen or gelatinous.

One or more charge directors as known to those skilled in the art can be added to impart a charge, as desired. Suitable nonpolar liquid soluble ionic or zwitterionic charge director compounds, which are generally used in an amount of 0.25 to 1,500 mg/g, preferably 2.5 to 400 mg/g developer solids, include: negative charge directors, e.g., lecithin, Basic Calcium Petronate® Basic Barium Petronate®, Neutral Barium Petronate, oil-soluble petroleum sulfonate, manufactured by Sonneborn Division of Witco Chemical Corp., New York, N.Y., alkyl succinimide (manufactured by Chevron Chemical Company of California), etc.; positive charge directors, e.g., sodium dioctylsulfo succinate (manufactured by American Cyanamid Co.), ionic charge directors such as zirconium octoate, copper oleate, iron naphthenate, etc.; nonionic charge directors, e.g., polyethylene glycol sorbitan stearate, nigrosine, triphenyl methane type dyes and Emphos® D70-30 C. and Emphos® F-27-85, sold by Witco Chem. Corp., NY, N.Y., sodium salts of phosphated mono- and diglycerides with unsaturated and saturated acid substituents, respectively.

As indicated above, colorants, when present, are dispersed in the resin. Colorants, such as pigments or dyes and combinations thereof, are preferably present to render the latent image visible. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments are Monastral® Blue G (C. I. Pigment Blue 15 C. I. No. 74160), Toluidine Red Y (C. I. Pigment Red 3), Quindo® Magenta (Pigment Red 122), Indo® Brilliant Scarlet (Pigment Red 123, C. I. No. 71145), Toluidine Red B (C. I. Pigment Red 3), Watchung® Red B (C. I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C. I. Pigment Yellow 1), Monastral® Blue B (C. I. Pigment Blue 15), Monastral® Green B (C. I. Pigment Green 7), Pigment Scarlet (C. I. Pigment Red 60), Auric Brown (C. I. Pigment Brown 6), Monastral® Green G (Pigment Green 7), Carbon Black, Cabot Mogul L (black pigment C. I. No. 77266) and Sterling NS N 774 (Pigment Black 7, C. I. No. 77266).

Other ingredients may be added to the electrostatic liquid developer, such as fine particle size oxides, e.g., silica, alumina, titania, etc.; preferably in the order of 0.5 μm or less can be dispersed into the liquefied resin. These oxides can be used instead of the colorant or in combination with the colorant. Metal particles can also be added.

Another additional component of the electrostatic liquid developer is an adjuvant which can be selected from the group of polyhydroxy compound which contains at least 2 hydroxy groups, aminoalcohol, polybutylene succinimide, metallic soap, and aromatic hydrocarbon having a Kauri-butanol value of greater than 30. The adjuvants are generally used in an amount of 1 to 1,000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxy-stearate, etc., described in Mitchell U.S. Pat. No. 4,734,352;

aminoalcohol compounds: triisopropanolamine, triethanolamine, ethanolamine, 3-amino-1-propanol, o-aminophenol, 5-amino-1-pentanol, tetra(2hydroxyethyl-)ethylenediamine, etc., described in Larson U.S. Pat. No. 4,702,985;

polybutylene succinimide: OLOA®1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc., described in El-Sayed and Taggi, U.S. Pat. No. 4,702,984;

metallic soap: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium cobalt, manganese, lead and zinc naphthenates; calcium, cobalt, manganese, lead and zinc resinates; etc. The metallic soap is dispersed in the thermoplastic resin as described in Trout, U.S. Pat. No. 4,707,429; and aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic® 100 which is a mixture of C9 and C10 alkyl-substituted benzenes and manufactured by Exxon Corp., described in Mitchell U.S. Pat. No. 4,663,264, etc. The disclosures of the aforementioned U.S. patents are incorporated herein by reference.

The particles in the electrostatic liquid developer preferably have an average by area particle size 10 μm or less. The average by area particle size determined by the Malvern 3600E Particle Size Analyzer can vary depending on the use of the liquid developer. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

In carrying out the process of the invention, a suitable mixing or blending vessel, e.g., attritor, heated ball mill, heated vibratory mill such as a Sweco Mill manufactured by Sweco Co., Los Angeles, Calif., equipped with particulate media, for dispersing and grinding, etc., is used. Generally the resin, colorant, and dispersant hydrocarbon liquid are placed in the vessel prior to starting the dispersing step at a percent solids of at least 22%, preferably 25 to 30% by weight. Optionally the colorant can be added after homogenizing the resin and the dispersant hydrocarbon liquid. Polar additive can also be present in the vessel, e.g., up to 100% based on the weight of polar additive and dispersant hydrocarbon liquid. The dispersing step is generally accomplished at elevated temperature, i.e., the temperature of ingredients in the vessel being sufficient to plasticize and liquefy the resin but being below that at which the dispersant hydrocarbon liquid or polar additive, if present, degrades and the resin and colorant, if present, decomposes. A preferred temperature range is 80 to 120° C. Other temperatures outside this range may be suitable, however, depending on the particular ingredients used. The presence of the irregularly moving particulate media in the vessel is needed to prepare the dispersion of toner particles. It has been found stirring the ingredients, even at a high rate, is not sufficient to prepare dispersed toner particles of proper size, configuration and morphology. Useful particulate media are particulate materials, e.g., spherical, cylindrical, etc. taken from the class consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar additive present, until the desired dispersion is achieved, typically 0.5 to 2 hour with the mixture being fluid, the dispersion is cooled to permit precipitation of the resin out of the dispersant. Cooling is accomplished in the same vessel, such as the attritor, while simultaneously grinding with particulate media to prevent the formation of a gel or solid mass. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Typical cooling temperatures may range from 15° C. to 50° C. Toner particles of average particle size (by area) of 10 μm or less, as determined by a Malvern 3600E Particle Sizer, 3.6 μm or less as determined using the Horiba centrifugal particle analyzer described above, or other comparable apparatus, are formed by grinding for a relatively short period of time when compared with former methods. It is preferred that the desired particle size be achieved within a normal work period, e.g., 8 hours or less, preferably 4 hours or less.

The Malvern 3600E Particle Sizer manufactured by Malvern, Southborough, Mass. which uses laser diffraction light scattering of stirred samples to determine average particle sizes. Since these two instrument use different techniques to measure average particle size the readings differ. The following correlation of the average size of toner particles in micrometers (μm) for the two instruments is:

| Value Determined By Malvern 3600 E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Malvern instrument.

After cooling and separating the dispersion of toner particles from the particulate media by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant hydrocarbon liquid as described previously above. The dilution is normally conducted to reduce the concentration of toner particles to between 0.1 to 10 percent by weight, preferably 0.3 to 3.0, and more preferably 0.5 to 2 weight percent with respect to the dispersant hydrocarbon liquid. One or more hydrocarbon liquid soluble ionic or zwitterionic charge director compounds of the type set out above, can be added to impart a positive or negative charge, as desired. The addition may occur at any time during the process; preferably at the end of the process, e.g., after the particulate media are removed and the concentration of toner particles is accomplished. If a diluting dispersant hydrocarbon liquid is also added, the ionic or zwitterionic compound can be added prior to, concurrently with, or subsequent thereto. If an adjuvant compound of a type described above has not been previously added in the preparation of the developer, it can be added prior to or subsequent to the developer being charged. Preferably the adjuvant compound is added after the dispersing step.

INDUSTRIAL APPLICABILITY

The improved process of this invention produces a liquid electrostatic developer which may have a plurality of fibers extending from the toner particles. The liquid developer contains toner particles having a controlled particle size range which can be prepared more quickly than by previously known processes using similar equipment for making liquid electrostatic developers. The developer is of the liquid type and is particularly useful in copying, e.g., making office copies of black and white as well as various colors; or color proofing, e.g., a reproduction of an image using the standard colors: yellow, cyan and magenta together with black as desired. In copying and proofing the toner particles are applied to a latent electrostatic image. Other uses are envisioned for the improved toner particles, e.g., the formation of copies or images using toner particles containing finely divided ferromagnetic materials or metal powders; conductive lines using toners containing conductive materials resistors, capacitors and other electronic components; lithographic printing plates, etc.

EXAMPLES

The following examples wherein the parts and percentages are by weight illustrate but do not limit the invention. In the examples the melt indices were determined by ASTM D 1238, Procedure A, the average particle sizes by area were determined by a Malvern 3600E Particle Sizer, manufactured by Malvern, Southborough, Mass., as described above, the conductivity was measured in picomhos/cm (pmhos) at 5 hertz and low voltage, 5 volts, and the density was measured using a Macbeth densitometer model RD918. The resolution is expressed in the Examples in line pairs/mm (1p/mm).

Example 1

Two black liquid developers were prepared by placing the following ingredients in a Union Process 1S Attritor, Union Process Company, Akron, Ohio:

| Ingredient | Amount (g) | |
|---|---|---|
| Sample | 1 | 2 |
| Copolymer of ethylene (89%) and methacrylic acid (11%) melt index at 190° C. is 100, acid No. is 66. | 399.2 | 399.2 |
| Heucophthal Blue G XBT-583D Heubach, Inc., Newark, NJ | 1.9 | 1.9 |
| Cabot N-774 Sterling NS carbon black, Cabot Corp., Carbon Black Division, Boston, MA. | 92.9 | 92.9 |
| Aluminum stearate, Low Gel II, Nuodex Inc., Piscataway, NJ | 5.0 | 5.0 |
| Isopar ® -L; nonpolar liquid having a Kauri-butanol value of 27, Exxon Corporation | 1167.0 | 1998.0 |

The ingredients were heated to 100° C. and milled at a rotor speed of 230 rpm with 0.1875 inch (4.76mm) diameter steel balls for one hour. The attritor was cooled while the milling was continued. Milling was continued at 50° C. and at a rotor speed of 340 rpm for the length of time required to produce similar particle sizes for Samples 1 and 2. Results are shown in Table 1 below. FIG. 1 is a plot of particle size (μm) versus cool grind (hours). AT 30% solids the grind time to achieve 6 μm particle size is 5 hours versus 21 hours grind time at 20% solids (control).

TABLE 1

| SAMPLE | % SOLIDS | PARTICLE SIZE (AFTER 6 HOURS) | GRIND TIME TO REACH 6 μm |
|---|---|---|---|
| 1 | 30 | 5.7 | 5 HOURS |
| 2 (Control) | 20 | 8.3 | 21 HOURS |

The developer was diluted and charged as follows: 1500 grams of 1.0% solids was charged with 7.5 grams of 10% Basic Barius Petronate ® oil soluble petroleum sulfonate, Sonneborn Div., Witco Chem. Corp., NY, N.Y. Image quality was determined using a Savin 870 copier at standard mode: charging corona set at 6.8 Kv and transfer corona set at 8.0 Kv. Results are tabulated in Table 2 below.

TABLE 2

| SAMPLE | COND (pmho) | PAPER | DENSITY (1p/mm) | RESOLUTION EFFICIENCY | TRANSFER |
|---|---|---|---|---|---|
| 1 | 16 | Savin | 1.59 | 10 | 67% |
| | | Offset | 2.05 | 10 | 78% |
| 2 | 13 | Savin | 1.61 | 10 | 60% |
| | | Offset | 2.09 | 10 | 74% |

Example 2

Two cyan liquid developers were prepared by placing the following ingredients in a Union Process 1S Attritor, Union Process Company, Akron, Ohio:

| Ingredient | Amount (g) | |
|---|---|---|
| Sample | 1 | 2 |
| Copolymer of ethylene (91%) and methacrylic acid (9%) melt index at 190° C. is 500, Acid No. is 54. | 369.3 | 369.3 |
| Monarch Blue X3627 pigment, Ciba-Geigy, Hawthorne, NY | 122.9 | 122.9 |
| Aluminum stearate, Low Gel II Nuodex Inc., Piscataway, NJ | 5.0 | 5.0 |
| Isopar ® -L; nonpolar liquid having a Kauri-butanol value of 27, Exxon Corporation | 927.0 | 1996.0 |

Figure 2:
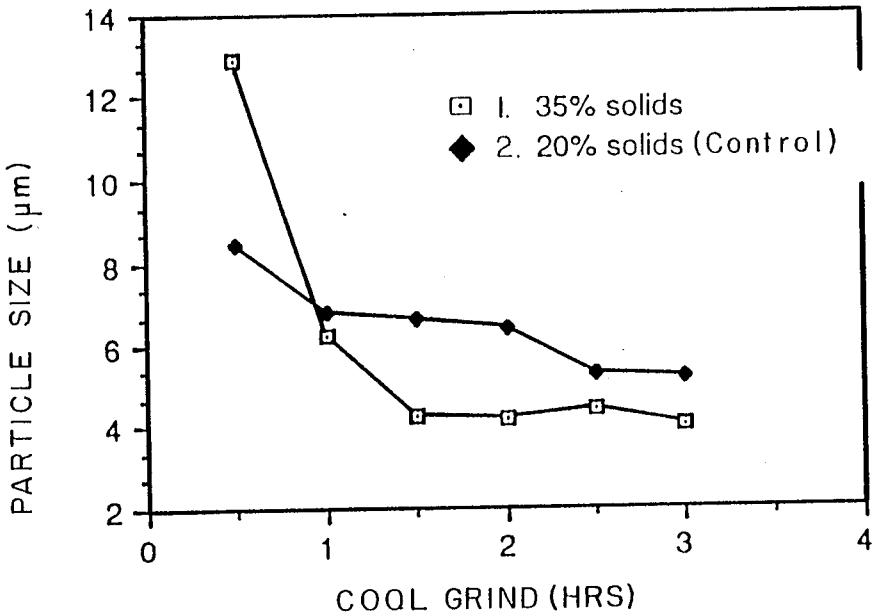
FIG. 2 is a plot of particle size (μm) at cool grind (hours) for another developer composition of the invention illustrated in Example 2 having 30% solids by weight and a similar plot of the developer composition having 15% solids by weight (control)

The ingredients were heated to 100° C. and milled at a rotor speed of 190 rpm with 0.1875 inch (4.76mm) diameter steel balls for one hour. The attritor was cooled while the milling was continued. Milling was continued at a temperature of 40° C. and at a rotor speed of 190 rpm for 3 hours. Results are shown in Table 3 below. FIG. 2 is a plot of particle size (μm) versus cool grind (hours). Cyan toner particles are initially smaller than the black toners of Example 1. Sample 1 achieves a particle size of 4 μm in about 1.5 hours grinding whereas Sample 2 reaches 5.2 in 3 hours.

TABLE 3

| SAMPLE | % SOLIDS | PARTICLE SIZE (μm) |
|---|---|---|
| 1 | 35 | 4.0 |
| 2 (Control) | 20 | 5.2 |

Example 3

Two black liquid developers were prepared by placing the following ingredients in a Union Process 1S Attritor, Union Process Company, Akron, Ohio:

| Ingredient | Amount (g) | |
|---|---|---|
| Sample | 1 | 2 |
| Elvacite ® 2014, a methacrylate copolymer, E. I. du Pont de Nemours and Co., Wilmington, DE | 200.0 | 200.0 |
| Uhlich BK 8200 laked carbon black Paul Uhlich and Co. Inc. Hastings-On-Hudson, NY | 35.3 | 35.3 |
| Isopar ® -L; nonpolar liquid having a Kauri-butanol value of 27, Exxon Corporation | 1331.0 | 786.0 |

Figure 3:
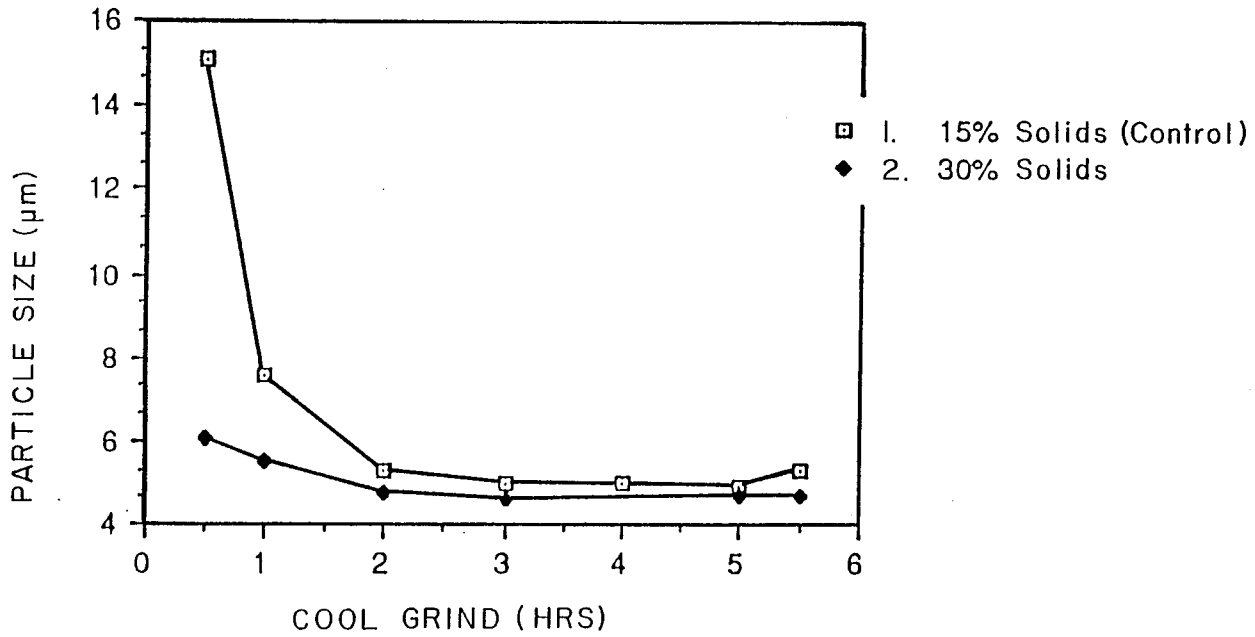
FIG. 3 is a plot of particle size (μm) at cool grind (hours) for still another developer composition of the invention illustrated in Example 3 having 30% solids by weight and a similar plot of the developer composition having 20% solids by weight (control).

The ingredients were heated to 100° C. and milled at a rotor speed of 190 rpm with 0.1875 inch (4.76 mm) diameter steel balls for one hour. The attritor was cooled while the milling was continued. Cool milling was continued at 33° C. (Sample 1) and 32° C. (Sample 2) and a rotor speed of 340 rpm for 5.5 hours. Results after 0.5 hour cool grinding are shown in Table 4 below. FIG. 3 is a plot of particle size (μm) versus cold grind (hours). Sample 2 achieves a particle size of 6 μm in 0.5 hour cool grinding. Sample 1 (control) particle size is ~15 μm in 0.5 hour cool grinding.

TABLE 4

| SAMPLE | % SOLIDS | PARTICLE SIZE (μm) |
|---|---|---|
| 1 (Control) | 15 | ~15 |
| 2 | 30 | 6 |

Example 4

Two black liquid developers were prepared by adding 394.2 grams of polystyrene, Aldrich Chemical Co., Milwaukee, Wis. having a weight average molecular weight of 250,000 determined by gel permeation chromatography (GPC), 99.8 grams of Cabot N-774 Sterling NS carbon black pigment, 5 grams of Aluminum Stearate, Low Gel II, Nuodex Inc., Piscataway, N.J. and the amount of Aromatic ®150 petroleum product, Exxon Corp., Houston, Tex. to a Union Process 1S Attritor, Union Process Company, Akron, Ohio charged with 0.1875 inch (4.76 mm) diameter carbon steel balls. The mixture was milled at 100° C. for 1 hour at 230 rpm then cooled and the mixture was cool milled at 50° C and 230 rpm for 4 hours. The particle size results of cool milling for 4 hours are set out in Table 5 below.

TABLE 5

| SAMPLE | AROMATIC ® 150 (g) | % SOLIDS | PARTICLE SIZE (μm) |
|---|---|---|---|
| 1 | 1167 | 30 | 1.8 |
| 2 | 1998 (control) | 20 | 2.7 |

Example 5

Two yellow liquid developers were prepared by placing the following ingredients in a Union Process 30-S Attritor, Union Process Company, Akron, Ohio:

| Ingredient | Amount (lb) | |
|---|---|---|
| Sample | 1 | 2 |
| Copolymer of ethylene (89%) and methacrylic acid (11) melt index at 190° C. is 100, Acid No. is 66 | 14.0 | 14.0 |
| Diarylide Yellow AAOT, Y-14, Polyethylene flushed color, Sun Chemical Corp., Cincinnati, OH | 3.59 | 3.59 |
| Aluminum Stearate, Low Gel II, Nuodex, Inc., Piscataway, NJ | 0.36 | 0.36 |
| Isopar ® -L; nonpolar liquid having a Kauri-butanol value of 27, Exxon Corporation | 102.0 | 40.0 |

The ingredients were heated to 90° C. and milled at a rotor speed of 100 rpm with 0.1875 in (4.76 (inch) diameter steel balls for 2 hours. Temperature was allowed to increase to 125° C. during this two-hour period. The attritor was cooled while the milling was continued. At 65° C., 24 lbs of Isopar ®-L was added in Sample 2. Milling was continued at 35° C. and a rotor speed of 100 rpm. Sample 1 was milled at 35° C. for 10 hours, while Sample 2 was milled at 35° C. for 4 hours. Results are shown in Table 6 below. For Sample 2 at about 22% solids during the cool grind, the grind time required to reach 8.0 μm was 2 hours, versus 10 hours for Sample 1 (control) at 15% solids.

TABLE 6

| Sample | Cool Grind % Solids | Particle Size (After 4 Hours) | Grind Time to Reach 8 μm |
|---|---|---|---|
| 1 (control) | 15% | 13.5 μm | 10 hours |
| 2 | 22% | 7.3 μm | 2 hours |

We claim:

1. A process for the preparation of toner particles for electrostatic liquid developers comprising A. dispersing at an elevated temperature in a vessel a thermoplastic resin, and a hydrocarbon liquid having a Kauri-butanol value of less than 120, such that the dispersion contains a total % solids of at least 22% by weight by means of moving particulate media whereby the moving particulate media creates shear and/or impact, while maintaining the temperature in the vessel at a temperature sufficient to plasticize and liquify the resin and below that at which the hydrocarbon liquid boils and the resin decomposes, B. cooling the dispersion containing a total % solids of at least 22% by weight in said vessel to permit precipitation of the resin out of the dispersant, the particulate media being maintained in continuous movement during and subsequent to cooling whereby toner particles having an average by area particle size of 10 μm or less are formed, and C. separating the dispersion of toner particles from the particulate media.

2. A process according to claim 1 wherein the particulate media are selected from the group consisting of stainless steel, carbon steel, ceramic, alumina, zirconium, silica, and sillimanite.

3. A process according to claim 2 wherein the particulate media are spherical having an average diameter of 0.04 to 0.5 inch.

4. A process according to claim 1 wherein the thermoplastic resin is a copolymer of ethylene (80 to 99.9%) and acrylic or methacrylic acid (0 to 20%)/alkyl $C_1$ to $C_5$ ester of methacrylic or acrylic acid (0 to 20%), the percentages being by weight.

5. A process according to claim 4 wherein the thermoplastic resin is a copolymer of ethylene (89%) and methacrylic acid (11%) having a melt index at 190° C. of 100.

6. A process according to claim 1 wherein a colorant is present.

7. A process according to claim 1 wherein the colorant is carbon black.

8. A process according to claim 1 wherein inorganic oxide fine particles are present.

9. A process according to claim 8 wherein the oxide is silica.

10. A process according to claim 1 wherein a combination of colorants is present.

11. A process according to claim 1 wherein after step C. a charge director is added to the dispersion to impart an electrostatic charge of predetermined polarity to the toner particles.

12. A process according to claim 11 wherein the thermoplastic resin is a copolymer of ethylene (89%)

and methacrylic acid (11%) having a melt index at 190° C. of 100.

13. A process according to claim 1 wherein a plurality of thermoplastic resins are employed in the plasticizing step A.

14. A process according to claim 1 wherein subsequent to step C. diluting the dispersion with additional hydrocarbon liquid.

15. A process according to claim 14 wherein the thermoplastic resin is a copolymer of ethylene (89%) and methacrylic acid (11%) having a melt index at 190° C. of 100.

16. A process according to claim 14 wherein the dilution is conducted to reduce the concentration of toner particles to between 0.1 to 3.0 percent by weight with respect to the hydrocarbon liquid.

17. A process according to claim 1 wherein the particles have an average by area particle size of 5 μm or less.

18. A process according to claim 1 wherein a colorant is present in step A and the temperature is maintained in the vessel below that at which the hydrocarbon liquid boils and the resin and colorant decomposes.

19. A process according to claim 1 wherein toner particles having a plurality of fibers extending therefrom are formed in step B.

20. A process according to claim 11 wherein an adjuvant selected from the group consisting of polyhydroxy compound, aminoalcohol, polybutylene succinimide, metallic soap, and aromatic hydrocarbon having a Kauri-butanol value of greater than 30, is added with the proviso that the metallic soap is dispersed in the thermoplastic resin.

21. A process according to claim 20 wherein the adjuvant compound is added after the dispersing step (A).

22. A process according to claim 1 wherein the hydrocarbon liquid has a Kauri-butanol value of less than 30.

23. A process according to claim 22 wherein the thermoplastic resin is a copolymer of ethylene and methacrylic acid.

24. A process according to claim 22 wherein at least one colorant is present.

25. A process according to claim 24 wherein after step C. a charge director is added to the dispersion.

26. A process according to claim 25 wherein the thermoplastic resin is a copolymer of ethylene and methacrylic acid.

27. A process according to claim 26 wherein subsequent to step C. diluting the dispersion with additional hydrocarbon liquid.

28. A process according to claim 27 wherein the toner particles having a plurality of fibers extending therefrom are formed in step B.

* * * * *